US007428927B2

(12) United States Patent
Vert et al.

(10) Patent No.: US 7,428,927 B2
(45) Date of Patent: Sep. 30, 2008

(54) CEMENT FLOAT AND METHOD FOR DRILLING AND CASING A WELLBORE WITH A PUMP DOWN CEMENT FLOAT

(75) Inventors: Jeffery Walter Vert, Red Deer (CA); Per G. Angman, Calgary (CA)

(73) Assignee: Tesco Corporation, Houston, TX (US)

( * ) Notice: Subject to any disclaimer, the term of this patent is extended or adjusted under 35 U.S.C. 154(b) by 101 days.

(21) Appl. No.: 10/297,633

(22) PCT Filed: May 25, 2001

(86) PCT No.: PCT/CA01/00764

§ 371 (c)(1),
(2), (4) Date: Aug. 5, 2003

(87) PCT Pub. No.: WO01/94739

PCT Pub. Date: Dec. 13, 2001

(65) Prior Publication Data

US 2004/0060700 A1 Apr. 1, 2004

(30) Foreign Application Priority Data

Jun. 9, 2000 (CA) ..... 2311160

(51) Int. Cl.
*E21B 33/16* (2006.01)
*E21B 33/14* (2006.01)

(52) U.S. Cl. ..... 166/285; 166/177.4; 166/242.8; 166/382; 175/57; 175/171

(58) Field of Classification Search ..... 166/281, 166/285, 373, 381, 382, 386, 105, 202, 177.4, 166/242.8; 175/57, 171, 170
See application file for complete search history.

(56) References Cited

U.S. PATENT DOCUMENTS

| | | | | |
|---|---|---|---|---|
| 1,350,553 | A | 8/1920 | Mack | |
| 1,395,718 | A | 11/1921 | Mack | |
| 2,179,017 | A | 11/1939 | Pieper | |
| 2,762,436 | A * | 9/1956 | Brown | 166/381 |
| 3,006,415 | A | 10/1961 | Burns et al. | |
| 3,097,707 | A | 7/1963 | Kammerer | |
| 3,385,372 | A * | 5/1968 | Knox | 166/325 |
| 3,552,508 | A | 1/1971 | Brown | |
| 3,552,510 | A | 1/1971 | Brown | |
| 3,603,412 | A | 9/1971 | Kammerer | |

(Continued)

OTHER PUBLICATIONS

Bob Tessari, Garret Madell, Tommy Warren, Drilling with Casing Promises Major Benefits, Oil & Gas Journal.

(Continued)

*Primary Examiner*—Shane Bomar
(74) *Attorney, Agent, or Firm*—Bracewell & Giuliani LLP

(57) ABSTRACT

A cement float collar is made for pumping downhole and into engagement with a groove formed in the casing, called the profile nipple. As such, no restriction is needed in the casing for accepting or latching the float collar and the portion of casing including the groove can be installed at the start of the drilling operation. In addition, the profile nipple can be used to engage other drilling tools and, therefore, can already be in place when the final well depth (TD) is reached.

27 Claims, 8 Drawing Sheets

U.S. PATENT DOCUMENTS 3,672,447 A 6/1972 Kofahl
3,732,143 A 5/1973 Joose
3,768,556 A * 10/1973 Baker ..... 166/154
3,913,686 A * 10/1975 Manson, Jr. ..... 175/39
3,957,114 A * 5/1976 Streich ..... 166/285
4,133,386 A * 1/1979 Knox ..... 166/285
4,175,619 A 11/1979 Davis
4,190,112 A * 2/1980 Davis ..... 166/291
4,413,682 A 11/1983 Callihan et al.
4,442,894 A 4/1984 Callihan et al.
4,589,495 A 5/1986 Langer et al.
4,616,719 A 10/1986 Dismukes
4,624,312 A * 11/1986 McMullin ..... 166/155
4,646,856 A 3/1987 Dismukes
4,856,592 A * 8/1989 Van Bilderbeek et al. ... 166/285
4,961,465 A * 10/1990 Brandell ..... 166/184
5,074,366 A 12/1991 Karlsson
5,105,883 A * 4/1992 Bode ..... 166/255.1
5,146,992 A * 9/1992 Baugh ..... 166/383
5,197,553 A * 3/1993 Leturno ..... 175/57
5,234,052 A * 8/1993 Coone et al. ..... 166/155
5,246,069 A 9/1993 Glaser et al.
5,323,858 A 6/1994 Jones et al.
5,472,057 A * 12/1995 Winfree ..... 175/57
5,483,986 A 1/1996 Onan et al.
5,551,521 A 9/1996 Vail, III
5,613,567 A 3/1997 Hudson
5,647,434 A * 7/1997 Sullaway et al. ..... 166/242.8
5,762,139 A * 6/1998 Sullaway et al. ..... 166/291
5,894,897 A 4/1999 Vail, III
5,909,771 A * 6/1999 Giroux et al. ..... 166/120
6,158,531 A 12/2000 Vail, III
6,244,342 B1 * 6/2001 Sullaway et al. ..... 166/285
6,263,987 B1 7/2001 Vail, III
6,311,775 B1 * 11/2001 Allamon et al. ..... 166/285
6,397,946 B1 6/2002 Vail, III
6,547,007 B2 * 4/2003 Szarka et al. ..... 166/317
6,868,906 B1 3/2005 Vail, III
7,013,997 B2 3/2006 Vail, III
7,036,610 B1 5/2006 Vail, III
7,040,420 B2 5/2006 Vail, III
7,048,050 B2 5/2006 Vail, III
7,100,710 B2 9/2006 Vail, III
7,108,084 B2 9/2006 Vail, III
7,147,068 B2 12/2006 Vail, III
7,165,634 B2 1/2007 Vail, III
2002/0000318 A1 * 1/2002 Allamon et al. ..... 166/291
2002/0129944 A1 * 9/2002 Moore et al. ..... 166/376
2002/0148615 A1 * 10/2002 Szarka et al. ..... 166/332.4

OTHER PUBLICATIONS

Bob Tessari, Garret Madell, Casing Drilling—A Revolutionary Approach to Reducing Well Costs, SPE/IADC Drilling Conference.
S.F. Shepard, R.H. Reiley, T.M. Warren, Casing Drilling: An Emerging Technology, SPE/IADC Drilling Conference.

* cited by examiner

CEMENT FLOAT AND METHOD FOR DRILLING AND CASING A WELLBORE WITH A PUMP DOWN CEMENT FLOAT

FIELD OF THE INVENTION

This invention relates to a cement float collar and a method of wellbore completion and, in particular, a through-tubing cement float collar and method for drilling and completing a wellbore using casing as the drill string.

BACKGROUND OF THE INVENTION

The drilling of wells, for example, for oil and gas production, conventionally employs relatively small diameter strings of drill pipe to which is secured a drill bit of somewhat larger diameter. After a selected portion of the well bore has been drilled, the wellbore is usually lined with a string of tubulars known as casing. The term casing is used herein to encompass any wellbore liner. The casing normally has a larger diameter than the drill pipe and a smaller diameter than the operational drill bit This conventional system which requires sequentially drilling the borehole using drill pipe with a drill bit attached thereto, pulling the drill pipe out of the hole and running casing into the borehole is time consuming and costly. In addition, each time that a drilling bit needs to be changed, which happens several times during any drilling operation, the drill pipe must be tripped in and out. As a consequence, the process of drilling with casing is gaining popularity as a method of drilling wherein the casing is used as the drilling conduit though which the bit is moved, and after drilling, the casing remains downhole to act as the wellbore liner.

To achieve simultaneous drilling and casing, a specialized drilling assembly is required which drills a borehole of sufficient diameter to accommodate the casing and which is retrievable through the casing. The drilling assembly typically includes a drill bit and one or more hole enlargement tools such as for example an underreamer. The drilling assembly is deployed on the advancing end of the casing. The drill bit can be retractable and/or removable through the casing by electric wireline, braided wire rope or other means.

When a drilling operation is complete the drill bit is retracted through the casing and the casing is left downhole for lining the well. Completion of the cased well, which requires pumping cement into the annulus between the casing and the wellbore wall, is difficult in wells formed using casing drilling since the casing does not contain a cement float shoe, also known as a cement float collar. Since it is necessary to complete a wellbore with cement, the cement was pumped down through the casing and maintained in the annulus by holding a pressure within the casing until the cement hardens.

While previous through-tubing cement float collars are known such as those described in U.S. Pat. Nos. 4,413,682, 5,323,858, 3,159,219 and 4,589,495, those float collars and methods for completion are not useful in casing drilling operations. In particular, a casing string having inner restrictions for latching a through tubing float collar is not suitable for use in casing drilling. The manipulation of the casing string or cement float collar using a tubing string within the casing is not suitable for most casing drilling operations.

SUMMARY OF THE INVENTION

A cement float collar is disclosed that can be positioned downhole and used in a wellbore completion operation after drilling a wellbore with casing. A wellbore drilling and completion method is also disclosed. The cement float collar is made for pumping downhole and into engagement with a groove formed in the casing, called the profile nipple. As such, no restriction is needed in the casing for accepting or latching the float collar and the portion of casing including the groove can be installed at the start of the drilling operation. In addition, the profile nipple can be used to engage other drilling tools and, therefore, can already be in place when the final well depth (TD) is reached.

In accordance with a broad aspect of the present invention, there is provided a cement float collar for use in a casing string to be used to line a wellbore, the casing including an annular groove at a lower distal end thereof, the annular groove having a diameter greater than the inner diameter of the casing string, the cement float collar comprising: a main body having a bore therethrough extending from its upper end to its lower end; a flow restriction assembly mountable in the bore to prevent flow of fluids therethrough at least from the lower end to the upper end of the main body; a sealing member disposed about the main body; a radially outwardly biased collar retained in an annular recess about the main body, the expanded outer diameter of the collar being greater than the inner diameter of the casing string in which it is to be used, the cement float with the collar compressed into the recess being sized to pass through the casing string with the sealing member creating a seal between the main body and the casing string, the seal being sufficient to substantially seal against fluids passing between the main body and the casing string at fluid pressures encountered in a wellbore completion operation and the collar being latchable into the groove of the casing string.

The collar is preferably formed of an outer bearing surface of durable material and an inner portion formed of drillable material. This combination of materials provides that the collar can withstand the rigours of passage downhole and is capable of latching into the groove but can be drilled out to permit the removal of substantially all of the float collar should this be necessary, for example, to extend the borehole.

In one embodiment, the annular recess has a sloping upper portion and a sloping lower portion and the collar is tapered at its upper end to coact with the sloping upper portion of the recess and tapered at its lower end to coact with the sloping lower portion of the recess, such that the collar can wedge between the main body and the casing string in which the cement float is used.

In accordance with another broad aspect of the present invention, there is provided a method for drilling a wellbore, comprising: providing a casing string having a known inner diameter and including an annular groove therein having a diameter greater than the casing string inner diameter at a lower distal end of the casing string, the casing string being suitable for remaining in the wellbore to line it and being suitable for acting as the drill string during drilling of the wellbore, and a drilling assembly retrievable through the casing string connected at the lower distal end of the casing string; drilling a wellbore using the drilling assembly; retrieving the drilling assembly to surface through the casing string without withdrawing the casing string from the wellbore; providing a cement float collar selected to pass through the casing string and latch into the groove; pumping the cement float collar through the casing string until it latches into the groove; and completing the wellbore by pumping cement through the casing string and through the cement float collar.

The cement float collar includes a bore therethrough and can include a shearable float collar in sealing position within the bore. In one embodiment, the method includes increasing fluid pressure above the cement float collar once the cement float is latched into the groove to shear the shearable float collar from the bore.

In one embodiment, the method further includes drilling through the cement and at least a portion of the cement float collar to extend the wellbore after completing the wellbore.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings:

In FIG. 2 the float collar valve is open permitting flow of fluids downwardly through the float collar, while in FIG. 3 the float collar valve is closed preventing reverse flow therethrough;

DESCRIPTION OF THE PREFERRED EMBODIMENTS OF THE INVENTION

Figure 1:
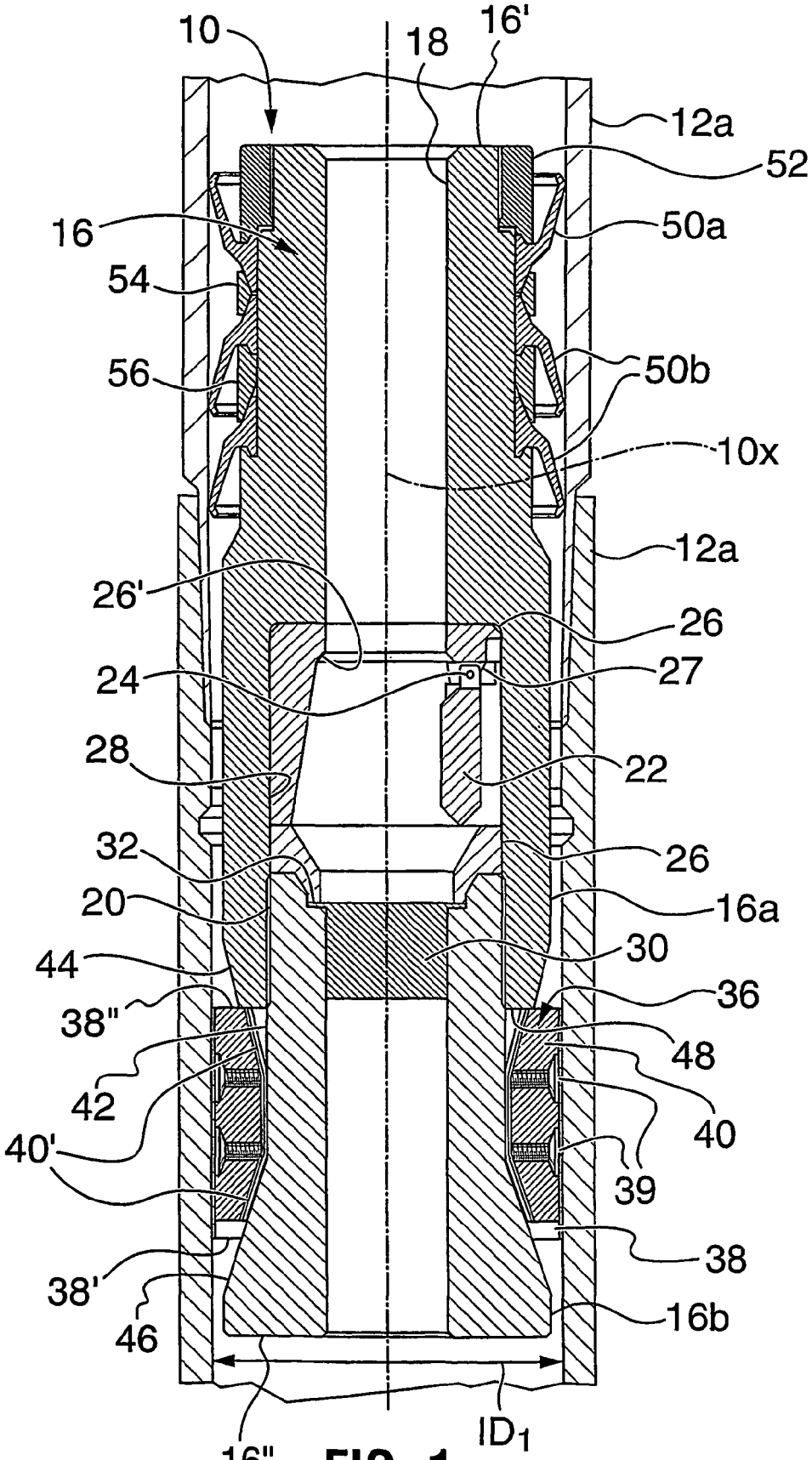
FIG. 1 is a vertical section through a portion of well casing including a cement float collar according to the present invention in a configuration for passing through the well casing.
Figure 2:
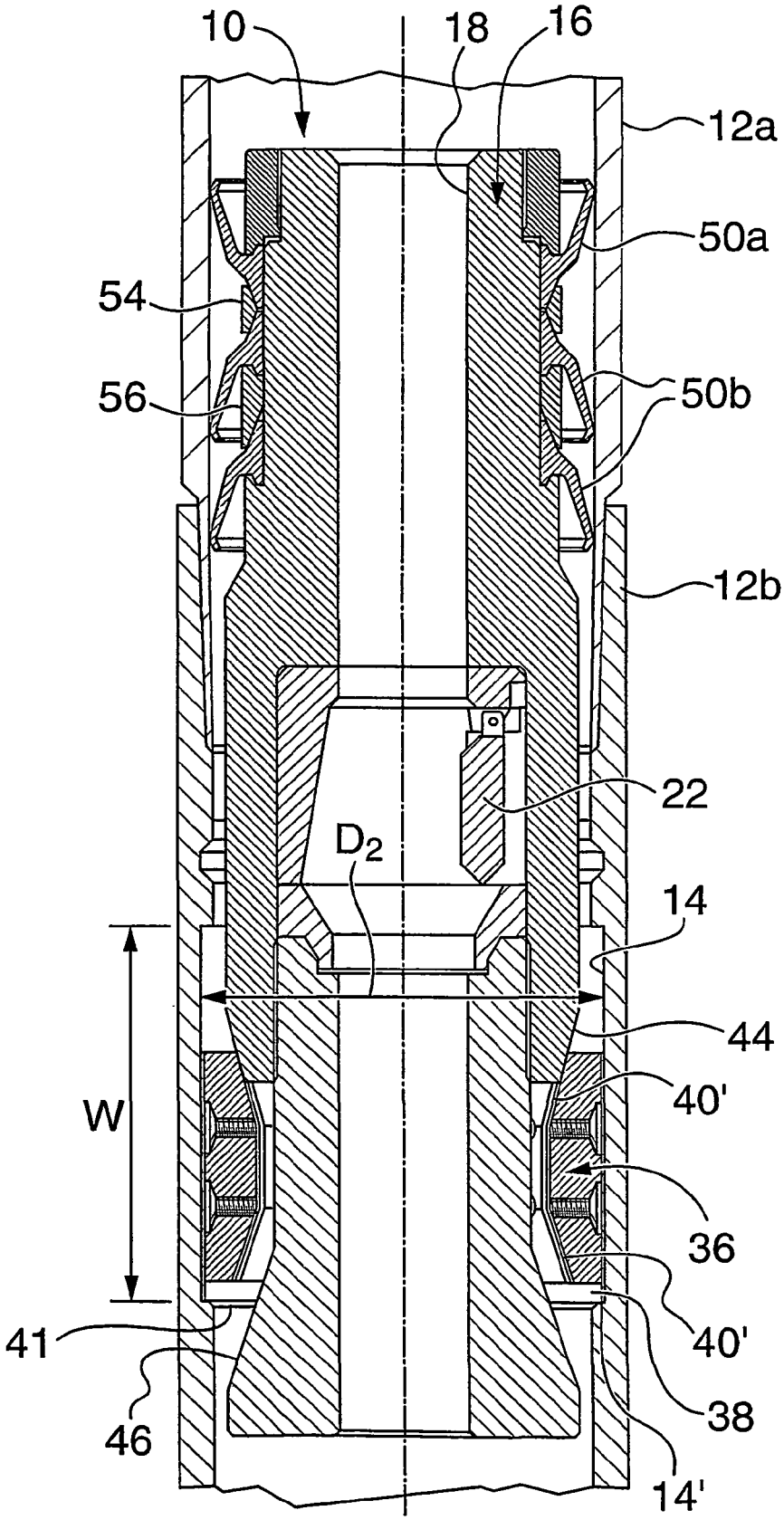
FIGS. 2 and 3 are vertical sectional views of the cement float collar of FIG. 1 in latched positions in a portion of well casing.
Figure 3:
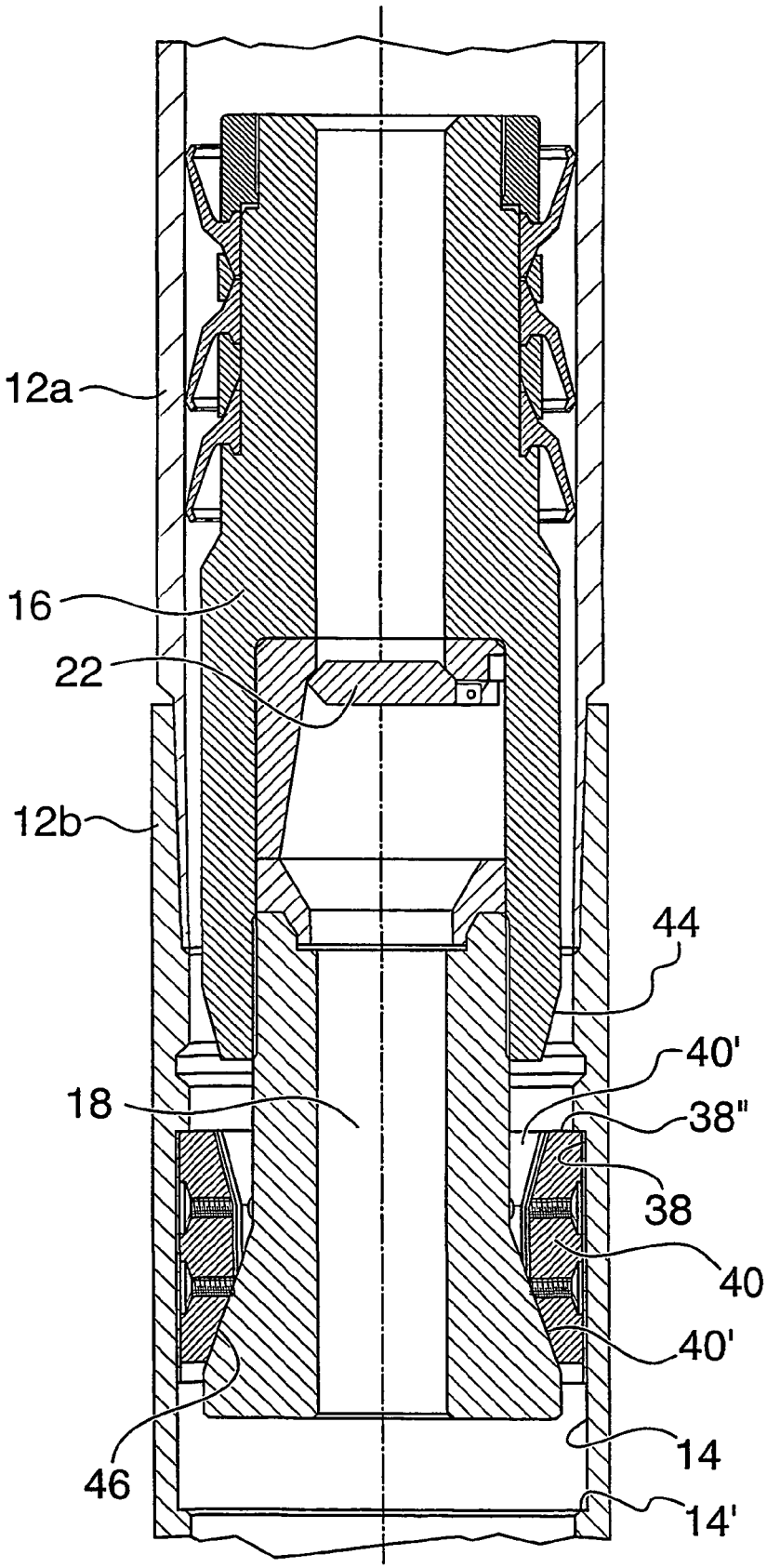

Referring to FIGS. 1 to 3, a cement float collar 10 according to the present invention is shown. Cement float collar 10 is formed to pass through a string of casing tubing, a portion of which is shown at 12*a*. Casing tubing 12*a* has a standard minimum inner diameter $ID_1$ so as not to limit the size of a tool that can pass therethrough. An annular groove 14 (FIGS. 2 and 3) is formed, as by milling, in a profile nipple 12*b* adapted to connect into the casing string by, for example, threaded connections. The diameter $D_2$ in groove 14 is slightly larger than the minimum inner diameter of the casing tubing. The cement float collar is formed to be pumped though a string of casing and to latch into and be retained in the annular groove, as will be more fully described hereinafter. The annular groove is formed to permit the cement float collar to be accepted without consideration as to the rotational orientation of the float collar in the casing.

FIG. 1 shows the cement float collar in a position being moved through a section of casing while FIGS. 2 and 3 show the cement float collar 10 secured in the casing in the annular groove of a profile nipple.

Cement float collar 10 includes a main body 16 having a longitudinal bore 18 extending from its upper end 16' to its lower end 16". Main body 16 is sized to pass easily through $ID_1$, of the size of casing in which it is intended to be used. To facilitate manufacture, main body is preferably formed from a plurality of parts including, for example, an upper section 16*a* and a lower mandrel section 16*b*. Parts 16*a* and 16*b* can be connected together in any way that provides a rigid connection therebetween. In the illustrated embodiment, sections 16*a* and 16*b* are joined at threaded connection 20. Parts 16*a* and 16*b* can be formed of any materials capable of at least for short periods withstanding downhole conditions. In some embodiments, the parts 16*a*, 16*b* must also be formed of materials capable of being drilled out such as, for example, aluminum or polyvinylchloride.

A float valve is positioned in bore 18 to permit only one-way flow therethrough from upper end 16' to lower end 16". While other one-way valves such as, for example, ball valves, are useful, the illustrated valve includes a flapper valve 22 mounted via a hinge pin 24 to a flapper valve housing 26. As will be appreciated by a person skilled in the art, flapper valve 22 is formed to seal against a seat 26' formed by housing 26 when a flow of fluid moves through the bore in a direction from lower end 16" to upper end 16' (FIG. 3). Flapper valve 22 is normally biased into the sealing position against seat 26' by a spring 27 such as, for example, a torsion spring acting about hinge pin 24. Bore 18 is enlarged at 28 to accommodate flapper valve housing 26. Flapper valve housing 26 is maintained in position within the bore by abutment against lower section 16*b*, where it is screwed into engagement with upper section 16*a*. Other valve types such as, for example, ball valves can be used, as desired, provided that they are durable enough to withstand the passage of cement therethrough.

For pumping downhole, a releasable plug 30 is disposed in bore 18. Releasable plug 30 is selected to remain in plugging position within bore 18 up to a selected maximum pressure. At pressures above the selected maximum pressure, plug 30 is driven out of bore 18. While many suitable pressure releasable plugs are known, the illustrated float collar includes a plug having a flange 32 engaged between valve housing 26 and lower section 16*b*. The plug is held in the bore by engagement of flange 32 against the shoulders formed by valve housing 26 and lower section 16*b* and by frictional engagement of the body of plug 30 against the walls of bore 18. When pressures acting against the plug are increased above the selected maximum pressure, the flange shears away from the plug body and the force of frictional engagement between plug 30 and the bore walls is overcome such that the plug is expelled from bore 18. The plug can be held in place by several different means such as, for example, shear screws. In another embodiment, a burst plate is used rather than a plug that is expelled. In a standard completion operation, the selected maximum pressure for expelling the plug is greater than the normal pressure required to pump the plug down the casing that is normally less than 500 psi. In a preferred embodiment, releasable plug 30 is selected to remain in place in the bore unless fluid pressures above the plug exceed about 1000 psi.

Figure 4:
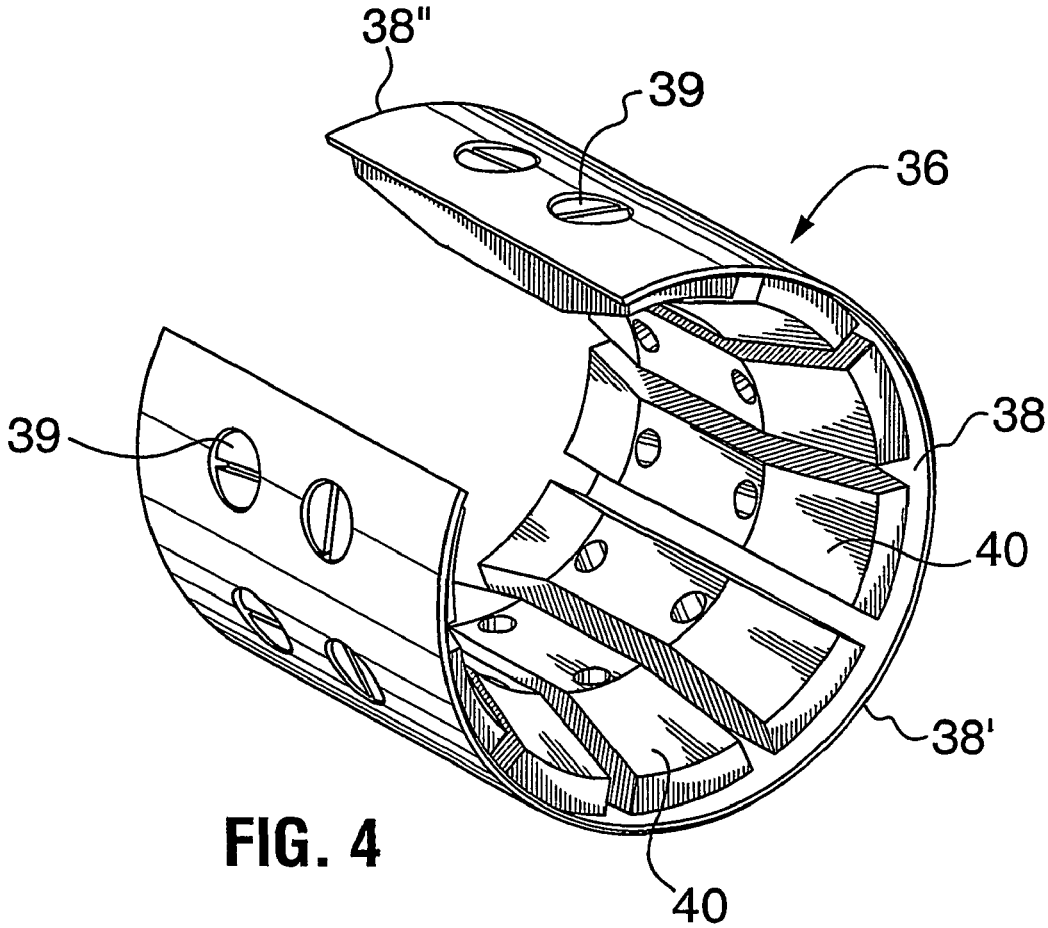
FIGS. 4 and 5 are perspective and end views, respectively, of a collar useful in a cement float collar according to the present invention.
Figure 5:
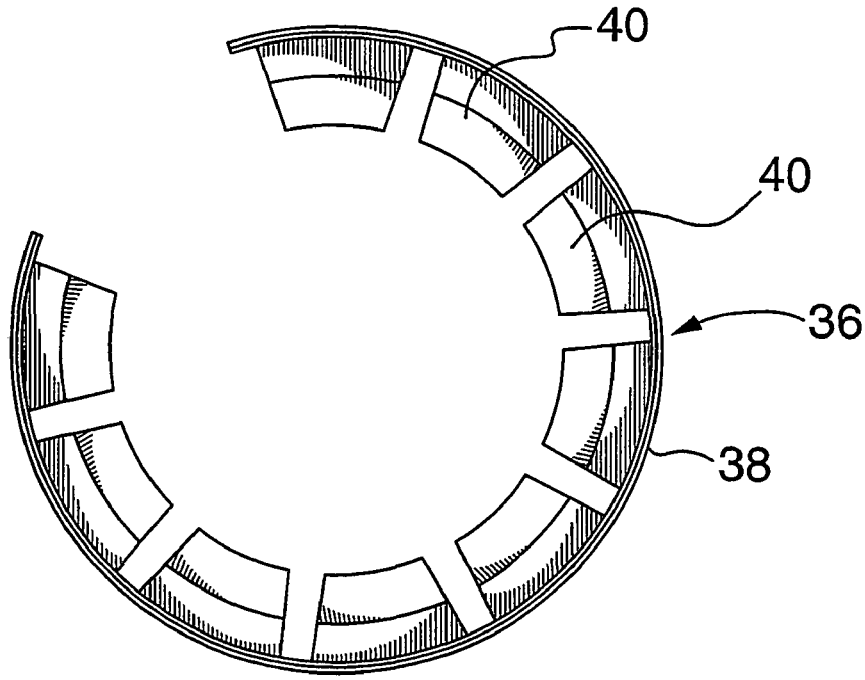

A collar 36 is mounted about the main body and is biased radially outwardly therefrom to engage in groove 14 of the profile nipple. Referring also to FIGS. 4 and 5, collar 36 includes an outer C-ring 38 and, attached there to, as by fasteners 39, a plurality of spaced-apart dogs 40. Collar 36 is biased outwardly by C-ring 38 that has an expanded outer diameter greater than $D_2$.

The spaces between dogs 40 permit the collar to be compressed against the spring force in C-ring 38 to fit into $ID_1$, of the casing string. The spring force in C-ring 38 is selected such that when the collar is compressed into the bore of a casing string, the force exerted outwardly by the collar can be overcome to move the collar and the float collar through the casing string by application of fluid pressure of about 500 psi to the cement float collar. The C-ring need only have the force to expand into the groove when it is reached.

C-ring 38 has a length between its leading edge 38' and its trailing edge 38" that is less than the width w of groove 14 such that the C-ring can expand into the groove. Groove 14 is formed with a wall 14', that steps generally abruptly from D2 to $ID_1$. The exposed corner 41 of wall 14' can be radiused, as shown, to facilitate movement therepast of equipment, for example during drilling. However, any radius should not be so great as to inhibit or jeopardize firm latching of the C-ring into groove 14. When the C-ring expands into groove 14 it becomes latched in it by abutment of leading edge 38' against wall 14' of groove 14 (FIG. 2). Upwards movement of cement float collar 10 is limited by abutment of edge 38" against the upper wall of the groove (FIG. 3). While the upper wall of the groove preferably steps abruptly from D2 to $ID_1$, again it may be necessary to ramp this wall to prevent catching of drilling equipment on the wall. However, the ramping should not interfere with the secure latching of the collar within the groove. Leading edge 38' is preferably curved as by rolling to facilitate movement through the casing string and over discontinuities such as casing connections. Any such curvature, however, must be of a limited radius so as to avoid interference with secure latching of the C-ring into groove 14 and abutment against wall 14'. While a cement plug can be used which is not drillable, in most applications it will be required that the plug be removable in order to expand the borehole. In one embodiment, the dogs are made of easily drillable materials such as, for example, aluminum or composites such as fiberglass. The fasteners are also formed of drillable material such as brass. However, since drillable materials are generally fragile and weak, particularly in tension, they may not capable of riding against the casing wall without failing and may not be capable of possessing the spring tension necessary for functioning of the collar. Therefore, the C-ring is preferably formed of a durable material capable of withstanding the rigors of passing downhole in engagement with the casing wall, the material also having spring tension, such as spring steel. The C-ring does not have be formed of drillable materials as it will be located in the groove out of the way of a drilling tool should one be used to remove the cement plug from the casing.

Collar 36 is retained in an annular recess 42 on main body 16. Annular recess 42 is positioned substantially orthogonal to the long axis 10*x* of the main body. In a preferred embodiment, recess 42 is formed with a sloping, frusto-conical upper portion 44 and a sloping, frusto-conical lower portion 46. Dogs 40 are each formed with tapered ends 40' such that the inner surfaces of the collar also define two generally frusto-conical surfaces selected to substantially mate with the surfaces of the recess. Movement of float collar 10 through collar 36 is limited by coacting of tapered ends 40' with frusto-conical portions 44, 46 of recess 42. In particular, movement of the float collar through the collar causes dogs 40 to be wedged between float collar body 16 and profile nipple 12*b* as shown in FIGS. 2 and 3.

To facilitate passage of the cement float collar through the casing string preferably recess 42 includes a stop wall 48 against which dogs 40 abut when in the compressed position. Stop wall 48 prevents movement of collar 36 upwardly on the cement float collar main body to thereby, prevent wedging of the dogs between the main body and the casing.

To prevent fluid flow between cement float collar 10 and casing string 12*a* during pumping down and between cement float collar 10 and profile nipple 12*b* when in position in groove 14, a plurality of seals 50*a*, 50*b* are provided about the cement float collar main body. As will be appreciated the seals are sized to extend out from main body to be in sealing engagement with casing when the cement float collar is positioned in a string of casing. Seals 50*a*, 50*b* are mounted in a recess formed in the main body and maintained in position by a threaded cup retainer 52, a coupling ring 54 and a spacer ring 56. Other secure mounting arrangements can be used as desired. Seals 50*a*, 50*b* are each cup-type seals. Seal 50*a* is arranged to act against passage of fluid therepast in a downhole direction while seals 50*b* are arranged to act against passage of fluid uphole. While three cup-type seals have been used in the illustrated embodiment, other numbers and types of seals can be used provided they create a seal against a passage of fluids between the cement float collar and the casing. Self-energizing seals such as cup seals are preferred as they are easy to work with and facilitate the pumping conveyance of the float collar. Other seals such as a standard packer could be used but may require energizing such as by pump pressure, drill pipe or tubing etc.

The seals must be able to withstand significant pressures which would be encountered in a wellbore completion operation. As an example, in one embodiment, the seals must be able to withstand about 1,000 psi from above during plug 30 shearing and, when holding the cement in place in the annulus, the seals must act against typically less than 2,000 psi from the bottom but sometimes as much as 3,000 psi from the bottom.

Figure 6A:
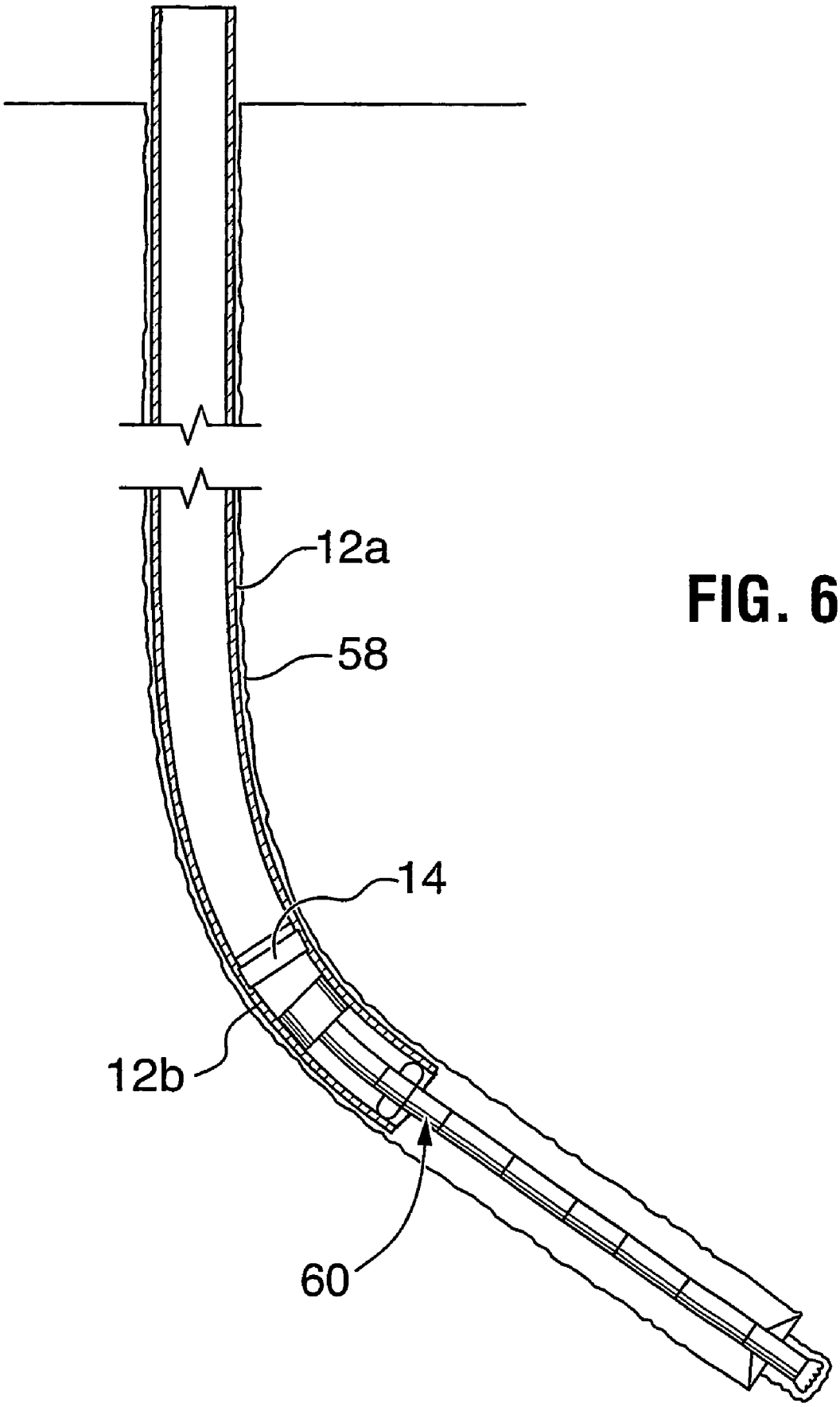
FIGS. 6A, 6B and 6C are schematic, vertical sections through a wellbore illustrating the method of the present invention.

Pump down cement float 10 is useful in casing drilling. Referring to FIG. 6A, when drilling with casing, well casing string 12*a* is used as the drill string and will thereafter be used as the wellbore liner. The wellbore 58 is formed using the casing string 12*a* with a drilling assembly 60 attached at the distal end of the casing string which is formed as a profile nipple 12*b*. The drilling assembly is retrievable from the lower distal end of the drill string without withdrawing the casing string from the wellbore being formed by drilling assembly 60. The casing must be open to permit passage and manipulation of the drilling assembly. The groove 14 in profile nipple 12*b* does not restrict passage and manipulation of the drilling assembly and can be installed on the casing string at the beginning of the drilling operation and the wellbore is drilled using a casing string including annular groove 14 at a lower distal end thereof at the location in which it is desired to locate a cement float during a completion operation. As an example, annular groove 14 can be positioned about 30 to 40 feet from the distal end of the casing string. The profile nipple can contain other recesses for use in securing other downhole tools.

When drilling is complete and it is desired to seal the annulus between the casing and the wellbore, the drilling assembly is removed through the casing string while leaving the casing string in place in the wellbore. Groove 14, having a diameter greater than that of the casing string, does not inhibit the passage of the drilling assembly or other downhole tools.

Figure 6B:
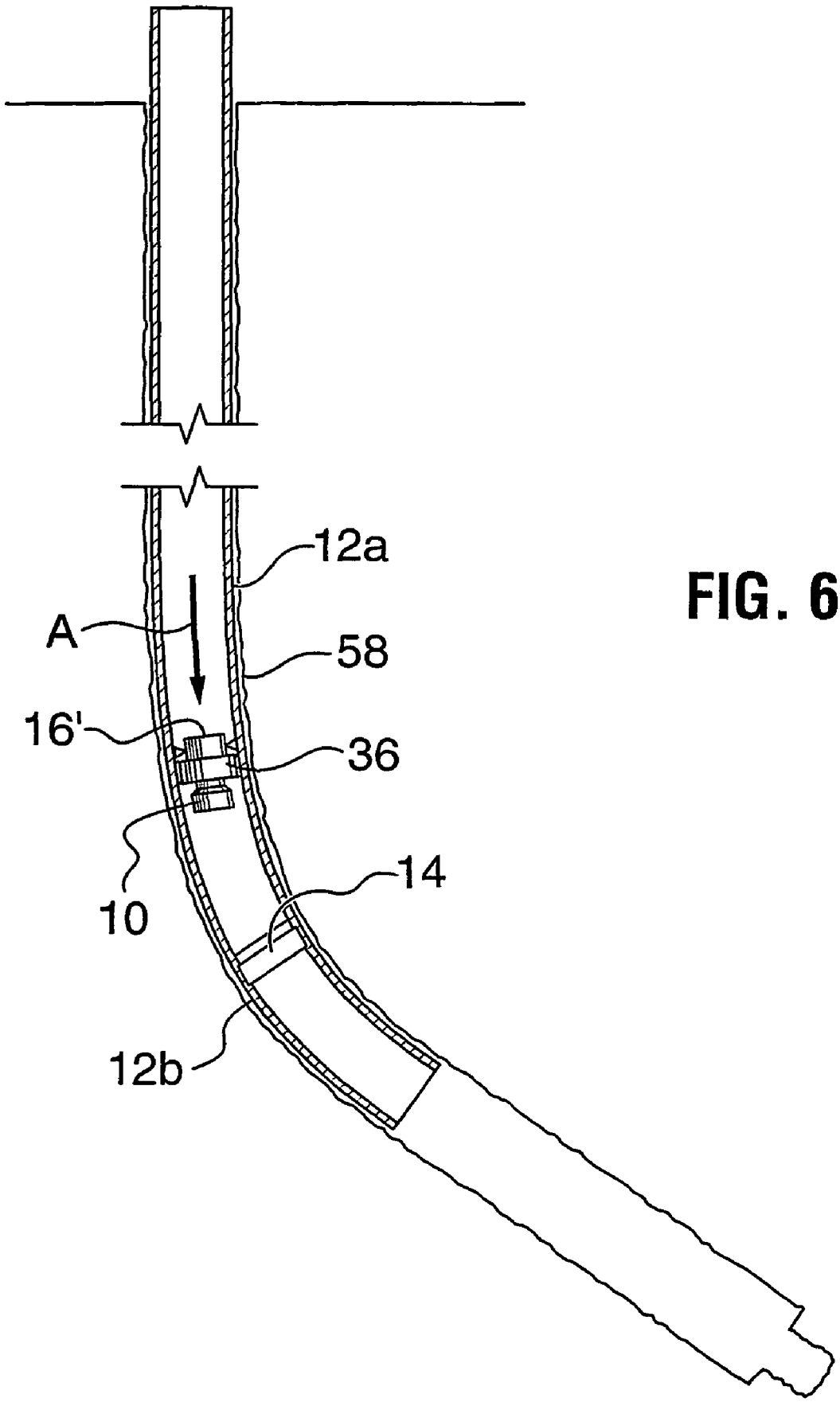

Referring to FIGS. 6B and 1, once the drilling assembly is removed, a pump down cement float 10 is selected that is capable of sealably passing through the casing string and latching into groove 14. The selected cement float is inserted into the casing string by compressing collar 36 into recess 42 and behind stop wall 48 such that the float collar fits within $ID_1$ of the casing string. The pressure of fluid, such as cement slurry or water, is increased (indicated by arrow A) against upper end 16' of float 10 to move it through the casing. The fluid pressure acts against seal 50*b*, main body 16 and plug 30 to drive the float against the force of C-ring 38 engaging the casing string wall. Pressures of between about 50 and 500 psi are required to move a float collar as shown in FIG. 1 through a casing string.

Figure 6C:
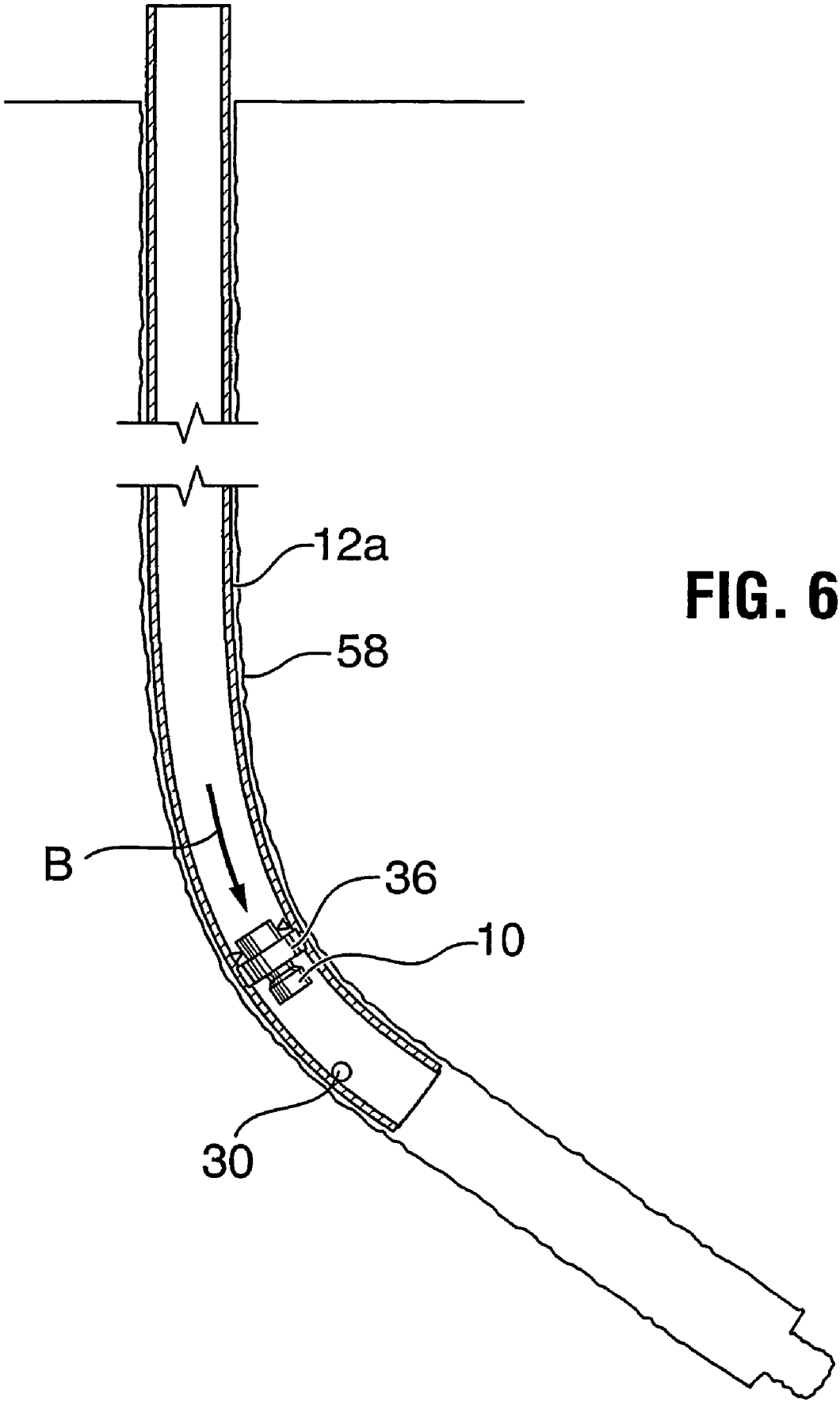
Figure 7:
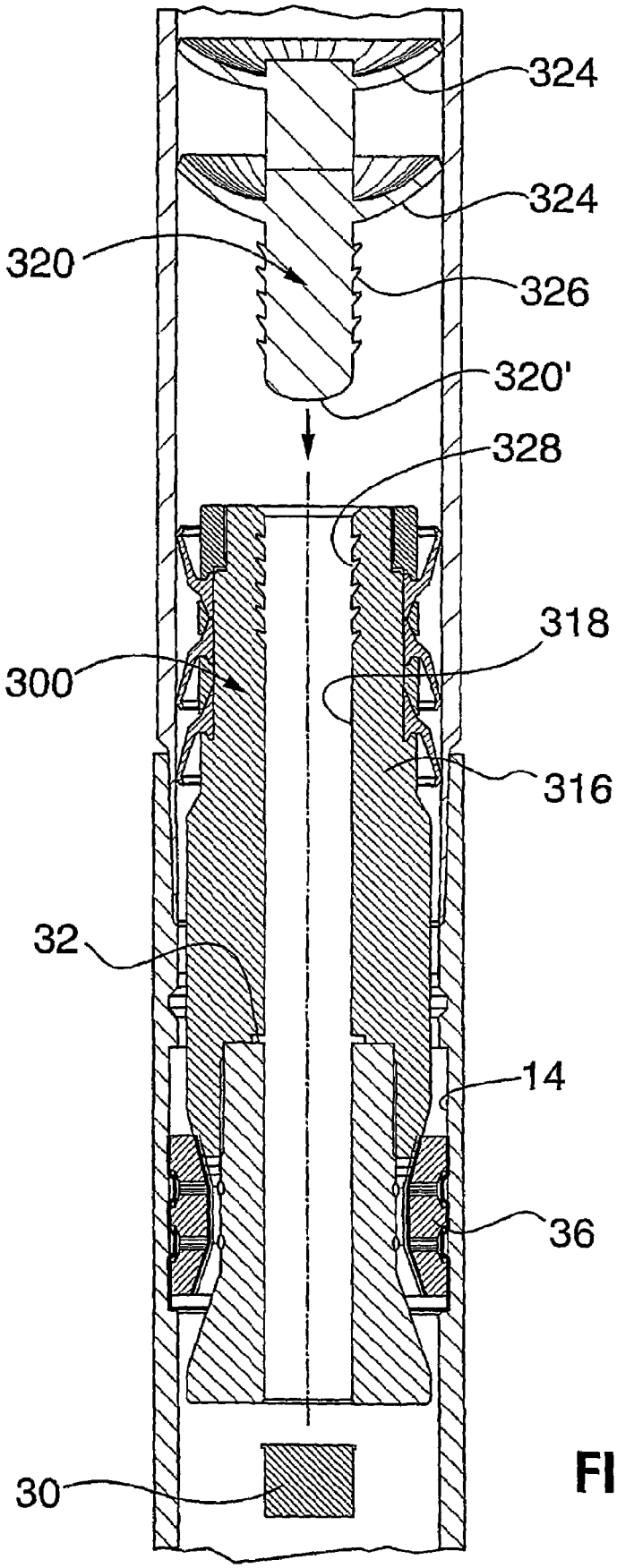
FIG. 7 is a vertical section through a portion of well casing including another cement float collar according to the present invention in a latched position in a portion of well casing.

Cement float 10 is pumped through the casing string until collar 36 lands in and expands into groove 14, as shown in FIGS. 2, 3 and 6C. When this occurs, the cement float is stopped by abutnent of leading edge 38' against groove wall 14' and subsequent wedging of dogs 40 between casing profile nipple 12*b* and main body 16.

To prepare the cement float for regulating the flow of cement, the pressure of the fluid (indicated by arrow B) uphole of the cement float collar is increased to a pressure selected to shear out plug 30 and allow fluid to flow through bore 18 of the float collar. Reversing fluid flow toward surface causes flapper valve 22 to seat. Cement can then be pumped downhole, through cement float 10 and up the annulus about the casing to complete the wellbore. A displacement plug (not shown) can be pumped down after the cement and lands on the cement float. When pressure is released at surface, the cement in the annulus tends to exert pressure to move back into the casing, called U-tubing. This causes flapper valve 22 to seal against seat 26' maintaining the cement in the annulus. Should float collar 10 move upwardly in groove 14, dogs 40 will become wedged between upper conical surface 44 of the recess and profile nipple 12*b* to prevent further movement of the float collar. Seals 50*b* prevent the cement from bypassing about the float collar.

The wellbore can be drilled, the cement float can be placed and the wellbore completed all without removing the casing string from the wellbore.

If it is later desired to extend the wellbore, it is possible to renter the casing string with a drilling assembly. Cement float 10, preferably being formed of drillable materials such a composites, aluminium, brass and/or polymers, can be drilled out along with the hardened cement. Since the groove has a diameter greater than that of the casing string, the drilling operation can open the casing up to substantially its original inner diameter without interference by the cement float or the groove.

Another embodiment of a cement float 300 according to the present invention is shown in FIG. 6. Cement float 300 includes a main body 316 with an axial bore 318 therethrough. A releasable plug 30 (shown being expelled from the bore) and a collar 36 are as described hereinbefore with respect to FIGS. 1 to 3. One way flow restriction through the float is provided by a displacement plug 320. Displacement plug 320 is pumpable downhole and latches into bore 318. In particular, plug 320 includes seals 324 extending therefrom to provide a seal against the casing, thereby, facilitating pumping downhole. The leading end 320' of the plug is sized to be insertable into bore 318 and has a plurality of hooks or ribs 326 extending therefrom that securely catch in a plurality of grooves 328 formed in the upper end of bore 318. Other engagement arrangements can be used such as, for example, a snap ring instead of the grooves. The engagement between hooks 326 and grooves 328 is sufficiently strong to retain plug 320 in the bore against pressures of typically less than 2,000 psi but preferably up to about 3,000 psi from below.

In use, main body 316, with releasable plug 30 in bore 318, is pumped down until collar 36 expands into groove 14. Pressure is increased until releasable plug 30 is sheared from bore 318. Cement is then pumped downhole through the casing string and bore 318 of cement float 300. When the appropriate amount of cement has been pumped down, the displacement plug 320 is launched and pumped down after the cement until it latches into bore 318 of main body 316. Plug 320 acts against U-tubing of the cement.

It will be apparent that many other changes may be made to the illustrative embodiments, while falling within the scope of the invention and it is intended that all such changes be covered by the claims appended hereto.

The invention claim is:

1. A method for drilling a wellbore, comprising: providing a casing string having a known inner diameter and including therein an annular groove having a diameter greater than the casing string inner diameter at a lower distal end of the casing string and a drilling assembly retrievable through the casing string connected at the lower distal end of the casing string; drilling a wellbore using the drilling assembly and casing string; retrieving the drilling assembly through the casing string without removing the casing string from the wellbore; providing a cement float selected to pass through the casing string in sealing engagement therewith, the cement float including a latch to latch into the groove; pumping the cement float through the casing string with the latch biased against the casing string inner diameter until the latch latches into the groove; and completing the wellbore by pumping cement through the casing string and through the cement float.

2. The method of claim 1 wherein the cement float includes a bore therethrough and a shearable plug in sealing position within the bore and the method further comprising increasing fluid pressure above the cement float once the cement float is latched into the groove to shear the shearable plug from the bore.

3. The method of claim 1 wherein the cement float includes a displacement plug latchable therein and the method further comprises after pumping cement through the casing string and the cement float, pumping the displacement plug through the casing string to latch into the cement float.

4. The method of claim 1, further comprising after completing the wellbore drilling out at least a portion of the cement float and the cement contained in the casing string.

5. A combination comprising: a casing string including an annular groove at a lower distal end thereof, the annular groove having a diameter greater than the inner diameter of the casing string and a cement float for use therein, the cement float including a main body having a bore therethrough extending from its upper end to its lower end; a flow restriction assembly mountable in the bore to prevent flow of fluids therethrough at least from the lower end to the upper end of the main body; a sealing member disposed about the main body, the sealing member selected to effect a seal between the cement float and the casing in which it is to be used; a radially outwardly biased collar retained in an annular recess about the main body, the expanded outer diameter of the collar being greater than the inner diameter of the casing string in which it is to be used, the cement float with the collar compressed into the recess being sized to pass through the casing string with the sealing member creating a seal between the main body and the casing string and the collar being latchable into the groove of the casing string.

6. The combination of claim 5 wherein the flow restriction assembly is a one way valve mounted in the bore.

7. The combination of claim 5 wherein the flow restriction assembly is a displacement plug pumpable downhole separately from the main body and latchable in the bore.

8. The combination of claim 5 wherein the annular recess has a sloping upper portion and a sloping lower portion and the collar is tapered at its upper end to coact with the sloping upper portion of the recess and tapered at its lower end to coact with the sloping lower portion of the recess, such that the collar can wedge between the main body and the casing string in which the cement float is used.

9. The combination of claim 5, wherein the main body is formed of easily drillable materials.

10. The combination of claim 9 wherein at least a portion of the collar is formed of easily drillable materials.

11. A cement float comprising: a main body having a bore therethrough extending from its upper end to its lower end; a flow restriction assembly mountable in the bore to prevent flow of fluids therethrough at least from the lower end to the upper end of the main body; an annular recess about the main body, the annular recess having a sloping upper portion and a sloping lower portion; a circumferential sealing member disposed about the main body; and a radially outwardly biased collar retained in the annular recess, the collar being tapered at its upper end to coact with the sloping upper portion of the recess and tapered at its lower end to coact with the sloping lower portion of the recess.

12. A cement float comprising:

a main body having an outer diameter, an annular recess with a recess diameter reduced from the outer diameter and a bore therethrough extending from a main body upper end to a main body lower end;

a flow restriction assembly mountable in the bore to prevent flow of fluids therethrough at least from the lower end to the upper end of the main body;

a radially extending, circumferential sealing member disposed about the main body;

a collar retained in the annular recess and being outwardly biased to define an expanded diameter extending beyond the main body outer diameter and being compressible to define a compressed diameter less than the expanded diameter;

wherein the collar includes an outer C-spring of durable materials; and inwardly extending dogs connected to the outer C-spring, the inwardly extending dogs formed to fit into and be retained in the annular recess.

13. The cement float of claim 12 wherein the inwardly extending dogs are formed of easily drillable materials.

14. The cement float of claim 12 wherein the annular recess is positioned between the seal and the main body lower end.

15. A pump down cement float comprising:

a main body having a bore therethrough extending from its upper end to its lower end;

a check valve mounted to the body to prevent flow of fluids through the bore from the lower end to the upper end of the main body;

a shearable plug in sealing position within the bore;

an annular recess about the main body, the recess having a sloping lower portion;

a self-energizing seal disposed about a circumference of the main body and extending outwardly therefrom for engaging a string of casing, the seal and the plug enabling the float to be pumped down the string of casing; and a collar retained in the annular recess and radially movable into engagement with the string of casing, the collar having a tapered surface at its lower end to co-act with the sloping lower portion of the recess and prevent upward movement of the float in the string of casing.

16. The pump down cement float of claim 15 wherein the self-energizing seal includes an upwardly acting seal cup and a downwardly acting seal cup.

17. The cement float of claim 16 wherein the annular recess is positioned between the self-energizing seal and the lower end of the main body.

18. A method for cementing a wellbore, comprising: providing a casing string having a known inner diameter defined by an inner wall and including therein at a lower distal end of the casing string an annular groove having a diameter greater than the casing string inner diameter; positioning the casing string in a wellbore; providing a cement float selected to pass through the casing string in sealing engagement therewith, the cement float including a collar compressible to fit into the casing string and expandable to latch into the groove; compressing the collar about the cement float to introduce it to the casing string; pumping the cement float through the casing string with the collar engaging the casing string inner wall until it latches into the groove; and completing the wellbore by pumping cement through the casing string and through the cement float.

19. The method of claim 18 wherein the cement float includes a bore therethrough and a shearable plug in sealing position within the bore and the method further comprising increasing fluid pressure above the cement float once the cement float is latched into the groove to shear the shearable plug from the bore.

20. The method of claim 18 wherein the cement float includes a displacement plug latchable therein and the method further comprises after pumping cement through the casing string and the cement float, pumping the displacement plug through the casing string to latch into the cement float.

21. The method of claim 18, further comprising after completing the wellbore drilling out at least a portion of the cement float and the cement contained in the casing string.

22. A method for cementing a wellbore, comprising: introducing a casing string to a wellbore, the casing string including a known inner diameter, a lower distal end and an annular groove having a diameter greater than the casing string inner diameter adjacent the lower distal end and the casing string being without a restriction in its inner diameter; pumping a cement float through the casing string until it anchors in the annular groove; and pumping cement through the casing string and through the cement float.

23. The method of claim 22 wherein the cement float includes a bore therethrough and a flow restriction in the bore of the float to prevent cement from flowing up through the cement float.

24. The method of claim 22 wherein the cement float includes a displacement plug latchable therein and the method further comprises after pumping cement through the casing string and the cement float, pumping the displacement plug through the casing string to latch into the cement float.

25. The method of claim 22, further comprising after completing the wellbore drilling out at least a portion of the cement float and the cement contained in the casing string.

26. The combination of claim 5, wherein the collar is radially outwardly biased by spring force.

27. The cement float of claim 12 wherein the collar is radially outwardly biased by spring force.

* * * * *